US007810923B2

(12) United States Patent
Koike

(10) Patent No.: US 7,810,923 B2
(45) Date of Patent: Oct. 12, 2010

(54) INK JET PRINTER

(75) Inventor: Yoshikazu Koike, Chino (JP)

(73) Assignee: Seiko Epson Corporation, Tokyo (JP)

( * ) Notice: Subject to any disclaimer, the term of this patent is extended or adjusted under 35 U.S.C. 154(b) by 420 days.

(21) Appl. No.: 11/958,991

(22) Filed: Dec. 18, 2007

(65) Prior Publication Data

US 2008/0158325 A1 Jul. 3, 2008

(30) Foreign Application Priority Data

Dec. 28, 2006 (JP) ..... 2006-353827

(51) Int. Cl.
*B41J 2/01* (2006.01)

(52) U.S. Cl. ..... 347/104; 347/16; 347/22; 347/33; 347/101; 400/648; 400/656

(58) Field of Classification Search ..... 347/33, 347/101, 104; 400/648, 656
See application file for complete search history.

(56) References Cited

U.S. PATENT DOCUMENTS

| | | | | |
|---|---|---|---|---|
| 7,497,567 | B2 * | 3/2009 | Kumagai | 347/104 |
| 2002/0135653 | A1 * | 9/2002 | Otsuki | 347/104 |
| 2005/0206708 | A1 * | 9/2005 | Yoda | 347/104 |
| 2006/0023049 | A1 * | 2/2006 | Koike et al. | 347/104 |
| 2007/0109384 | A1 * | 5/2007 | Takeda et al. | 347/104 |
| 2007/0132799 | A1 * | 6/2007 | Ilda | 347/16 |
| 2007/0132824 | A1 * | 6/2007 | Iida et al. | 347/101 |

FOREIGN PATENT DOCUMENTS

| | | |
|---|---|---|
| JP | 2001-030481 | 2/2001 |
| JP | 2001-30481 A * | 6/2001 |
| JP | 2002-086821 | 3/2002 |
| JP | 2003-104600 | 4/2003 |
| JP | 2005-035166 | 2/2005 |
| JP | 2005-075475 | 3/2005 |
| JP | 2005-088329 | 4/2005 |
| JP | 2006-326990 | 12/2006 |

OTHER PUBLICATIONS

Machine Translation of JP2001-30481A Jun. 2, 2001.*

* cited by examiner

*Primary Examiner*—Ryan Lepisto
(74) *Attorney, Agent, or Firm*—Workman Nydegger

(57) ABSTRACT

In an ink jet printer, a plurality of transport belts are disposed at a predetermined interval in a direction intersecting a transport direction of a printing medium, the printing medium is absorbed on the transport belts to be transported, and an ink jet head ejects an ink droplet on the printing medium transported by the transport belts to perform a printing operation, and a support member that gradually lifts the end portions of the transported printing medium in the direction intersecting the transport direction up to the height of circumferential surfaces of the transport belts is disposed between the plurality of transport belts and below the circumferential surfaces of the transport belts.

3 Claims, 6 Drawing Sheets

INK JET PRINTER

BACKGROUND

1. Technical Field

The present invention relates to an ink jet printer that forms predetermined characters and images by ejecting ink droplets of, for example, a plurality of colors through a plurality of nozzles to form particles (ink dots) on a printing medium.

2. Related Art

As a personal computer or a digital camera has come in to wide use, such an ink jet printer has been widely used in an office and home because the ink jet printer is cheap and can print a high-quality of a color image in general.

In such an ink jet printer, while reciprocating in a direction intersecting a transport direction of the printing medium, a moving unit called a carriage that has an ink cartridge and a printing head generally ejects ink droplets through the nozzles of the printing head and forms ink dots on the printing medium in order to obtain desired characters or images. In addition, the carriage includes ink cartridges of four colors (yellow, magenta, cyan, and black) and the printing heads of the colors. Accordingly, the ink jet printer can perform a mono-color printing operation and also perform a full-color printing operation (where in addition to the four colors, light cyan, and light magenta, ink cartridges of 6 colors, 7 colors, or 8 colors are available).

In the ink jet printer that performs the printing operation while reciprocating the ink jet head of the carriage in the direction intersecting the transport direction of the printing medium, the ink jet heads have to reciprocate 10 or more times in order to print an image of an one-page. In contrast, in an ink jet printer having a longitudinal ink jet head (which does not need to be an incorporated unit) of which the size is the same as the width of the printing medium and having no carriage, it is not necessary to move the ink jet head in a transverse direction of the printing medium and the printing operation is possible by passing the printing medium just once. Therefore, a high-speed printing operation is possible. In general, the ink jet printer of the former type is called "a multi-pass (serial) type ink jet printer" and the ink jet printer of the latter type is called "a line head type ink jet printer". In particular, the line head type ink jet printer allows a transport belt to absorb the printing medium by electrostatic absorption, air absorption, or the like in order to transport the printing medium.

Such a method of transporting the printing medium is particularly effective in the line head type ink jet printer. In an ink jet printer disclosed in JP-A-2005-75475, line head type ink jet heads are disposed upstream and downstream in a transport direction of a printing medium, a plurality of transport belts are disposed in a direction intersecting the transport direction of the printing medium at a predetermined interval, the printing medium is electrostatically absorbed on the transport belts to be transported, ink droplets are ejected on the transported printing medium from the ink jet heads disposed upstream and downstream. The ink jet heads are disposed at spaces between the transport belts and cleaning units directly below the ink jet heads perform a so-called cleaning operation in order to clean, for example, nozzles of the ink jet heads.

However, in order for such an ink jet printer to print a high-quality image, the ink droplets have to be ejected on an exact target position of the printing medium. Accordingly, a distance (gap) between the nozzle surface of the ink jet heads and the surface of the printing medium has to be uniform. However, when the printing medium is transported by the plurality of transport belts described above, the end portions (which are the end portions of the printing medium in the transverse direction of the printing medium when the transport direction of the printing medium refers to a longitudinal direction and a direction interesting the direction of the printing medium refers to a transverse direction) of the printing medium which is not loaded on the transport belt in the direction intersecting the transport direction of the printing medium droops. Then, the distance between the nozzle surface of the ink jet heads and the surface of the printing medium may be changed. In order to solve this problem, an ink jet printer disclosed in JP-A-2005-88329 is configured so that support members each having a plurality of plate-like members are disposed between the plurality of transport belts, portions of the plate-like members upstream side in the transport direction of the printing medium are chamfered, and the end portions of the transported printing medium in the direction intersecting the transport direction of the printing medium, that is, the drooping end portions are lifted by the chamfered plate-like members.

However, in the ink jet printer disclosed in JP-A-2005-88329, for example, all the chamfered portions of the plurality of plate-like members are of the same size. Therefore, the end portions of the transported printing medium in the direction intersecting the transport direction almost simultaneously come in contact with the plurality of plate-like members constituting the support members. However, since the endmost portions of the transported printing medium in the direction intersecting the transport direction further droop, the more drooping end portions of the printing medium in the direction intersecting the transport direction may not be placed on the chamfered portions of the plate-like members, but may collide with portions below the chamfered portions. If the end portions of the printing medium in the direction intersecting the transport direction collide with the plate-like members in this manner, transport failure, so-called paper-sheet jam may occur. This problem can frequently occur in the printing medium with low rigidity or the printing medium of which the rigidity is reduced due to ink absorbed by the printing medium.

SUMMARY

An advantage of some aspects of the invention is that it provides an ink jet printer that can lift drooping end portions of a printing medium in a direction intersecting a transport direction of the printing medium without transport failure of the printing medium.

According to an aspect of the invention, there is provided an ink jet printer in which a plurality of transport belts are disposed at a predetermined interval in a direction intersecting a transport direction of a printing medium, the printing medium is absorbed on the transport belts to be transported, and an ink jet head ejects an ink droplet on the printing medium transported by the transport belts in order to perform a printing operation. In the ink jet printer, a support member that gradually lifts the end portions of the transported printing medium in the direction intersecting the transport direction up to the height of circumferential surfaces of the transport belts is disposed between the plurality of transport belts and below the circumferential surfaces of the transport belts.

According to the ink jet printer having the above-described configuration, the support members for gradually lifting the end portions of the transported printing medium in the direction of the transport direction up to the height of the circumferential surfaces of the transport belts are disposed between the plurality of transport belts and below the circumferential surfaces of the transport belts. In addition, the support members lift the end portions of the transported printing medium in the direction of the transport direction at the later timing as they are positioned closer to the end portions of the printing medium in the direction interesting the transport direction and lift the inner portions thereof at the earlier timing as they are positioned closer the inner portions of the printing medium in the direction interesting the transport direction. In this case, since the considerably drooping end portions of the printing medium in the direction of the transport direction are also gradually lifted, and the end portions of the printing medium in the direction of the transport direction are lifted by the support members, the support member can be prevented from colliding with the end portions of the printing medium in the direction of the transport direction. Therefore, it is possible to lift the drooping end portions of the printing medium in the direction of the transport direction up to the height of the circumferential surface of the transport belts without the transport failure of the printing medium.

In the ink jet printer having the above-described configuration, the support member may include a plurality of plate-like members that are disposed in the direction intersecting the transport direction of the printing medium, and the plate-like members may gradually lift the end portions of the transported printing medium in the direction intersecting the transport direction at later timing as they are positioned closer to the end portions of the transported printing medium in the direction intersecting the transport direction.

According to the ink jet printer having the above-described configuration, as the support member, the plurality of plate-like members are disposed in the direction interesting the transport direction of the printing medium. The plate-like members gradually lift the end portions of the printing medium in the direction intersecting the transport direction up to the height of the circumferential surfaces of the transport belts at the later timing as they are positioned closer to the end portions of the printing medium in the direction of the transport direction. Accordingly, the considerably drooping end portions of the printing medium in the direction intersecting the transport direction are gradually lifted and the end portions of the printing medium in the direction intersecting the transport direction are lifted by the plate-like members. As a result, as the support member the plate-like members can be prevented from colliding with the end portions of the printing medium in the direction intersecting the transport direction.

In the ink jet printer having the above-described configuration, portions of the plurality of plate-like members upstream in the transport direction may be chamfered, and the chamfered portions of the plate-like members may become larger as they are positioned closer to the end portions of the transported printing medium in the direction intersecting the transport direction.

According to the ink jet printer having the above-described configuration, the portions of the plurality of plate-like members upstream in the transport direction are chamfered and the chamfered portions of the plate-like members become larger as they are positioned closer to the end portions of the transported printing medium in the direction intersecting the transport direction. Accordingly, the plate-like members can gradually lift the end portions of the printing medium in the direction intersecting the transport direction up to the height of the circumferential surfaces of the transport belts at the later timing as they are positioned closer to the end portions of the printing medium in the direction intersecting the transport direction.

In the ink jet printer having the above-described configuration, portions of the plurality of plate-like members upstream in the transport direction may be curved and the radii of the curved portions of the plate-like members may become larger as they are positioned closer to the end portions of the transported printing medium in the direction intersecting the transport direction.

According to the ink jet printer having the above-described configuration, the portions of the plurality of plate-like members upstream in the transport direction are curved and the radii of the curved portions of the plate-like members become larger as they are positioned closer to the end portions of the transported printing medium in the direction intersecting the transport direction. Accordingly, the plate-like members can gradually lift the end portions of the printing medium in the direction intersecting the transport direction up to the height of the circumferential surfaces of the transport belts at the later timing as they are positioned closer to the end portions of the printing medium in the direction intersecting the transport direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an ink jet printer according to a first embodiment of the invention will be described with reference to the drawings.

Figure 1A:
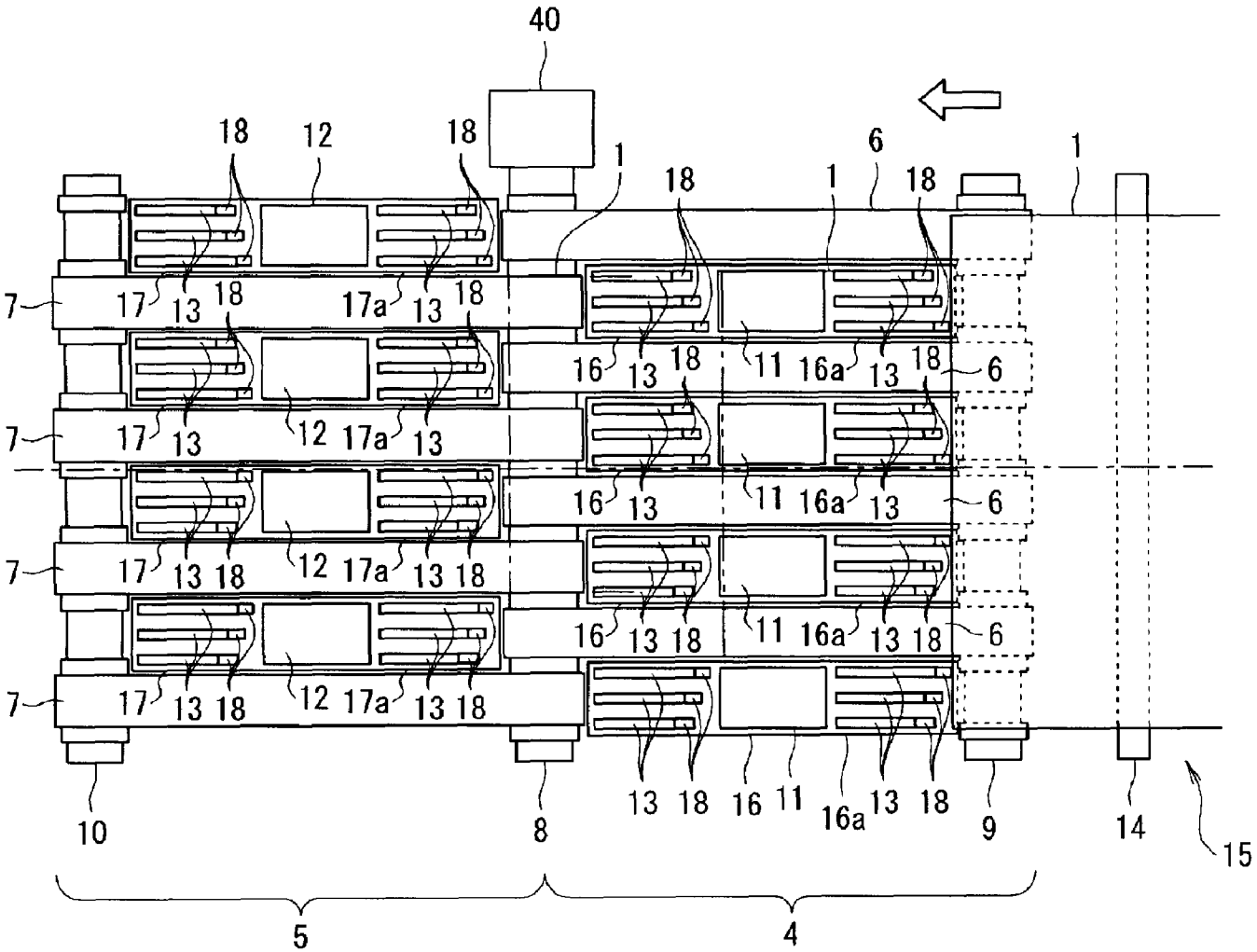
FIG. 1A is a top view illustrating an overall configuration of an ink jet printer according to a first embodiment of the invention and FIG. 1B is a front view illustrating the overall configuration of the ink jet printer according to the first embodiment of the invention.
Figure 1B:
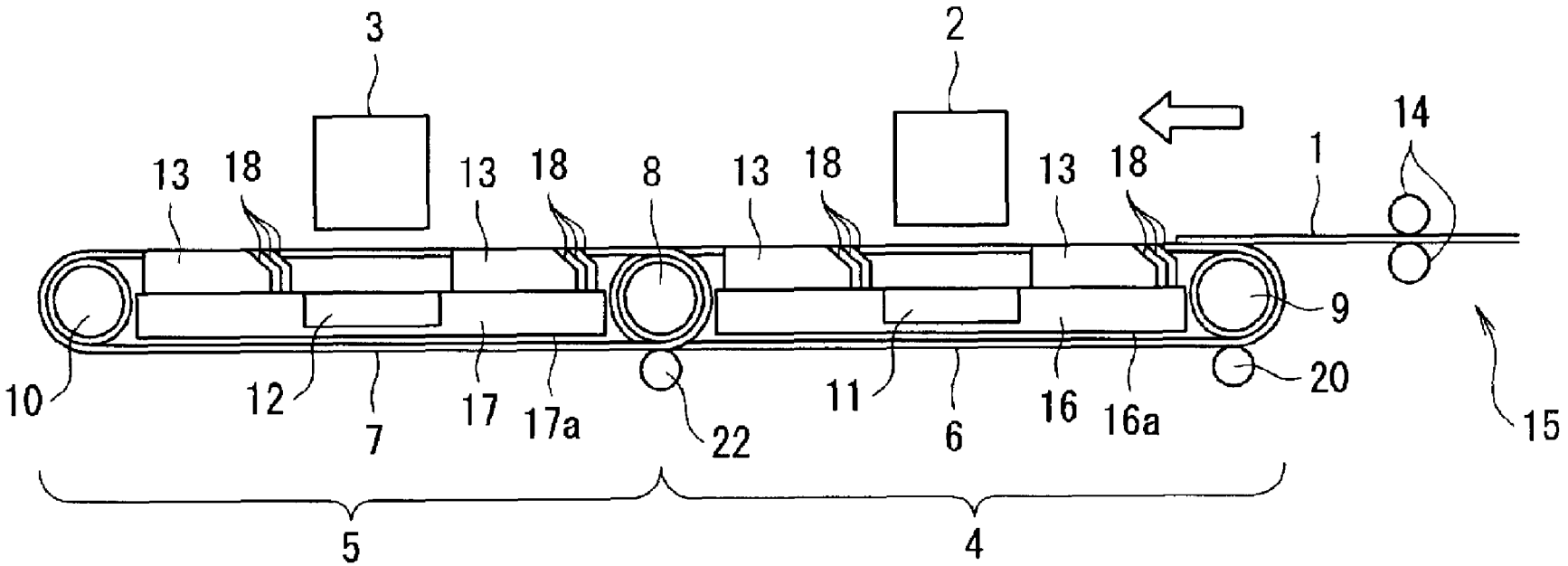

FIG. 1A is a top view illustrating an overall configuration of an ink jet printer according to a first embodiment of the invention and FIG. 1B is a front view illustrating the overall configuration of the ink jet printer according to the first embodiment of the invention. In FIGS. 1A and 1B, a printing medium 1 is transported in an arrow direction from a right side to a left side and a line head type ink jet printer performs a printing operation on the printing medium 1 in a printing area during transport of the printing medium 1. In FIG. 1A, a two-dotted line indicates the printing medium 1 with a different size. In this embodiment, ink jet heads are disposed at two positions.

In FIGS. 1A and 1B, Reference Numeral 2 denotes first ink jet heads disposed upstream in a transport direction of the printing medium 1. Likewise, Reference Numeral 3 denotes second ink jet heads disposed downstream in the transport direction of the printing medium 1. A first transport belt 4 and a second transport belt 5 that transport the printing medium 1 are disposed below the first ink jet heads 2 and the second ink jet heads 3, respectively. The first transport belt 4 includes four first endless belts 6 that are disposed in a direction (hereinafter, referred to as a nozzle row direction) intersecting the transport direction of the transporting medium 1 at a predetermined interval. Likewise, the second transport belt 5 includes four second endless belts 7 that are disposed in the direction (the nozzle row direction) intersecting the transport direction of the transporting medium 1 at a predetermined interval.

The four first endless belts 6 and the four second endless belts 7 are alternately disposed so as to be adjacent to each other. A driving roller 8 is disposed at a position where the first endless belts 6 and the second endless belts 7 are adjacent to each other. In addition, a first driven roller 9 and a second driven roller 10 are disposed more upstream and more downstream than the position where the first endless belts 6 and the second endless belts 7 are adjacent to each other. The first endless belts 6 are wound on the driving roller 8 and the first driven roller 9 and the second endless belts 7 are wound on the driving roller 8 and the second driven roller 10. A transport belt driving motor 40 is connected to the driving roller 8. Accordingly, when the driving roller 8 is rotatably driven by the transport belt driving motor 40, the first transport belt 4 including the first endless belts 6 and the second transport belt 5 including the second endless belts 7 are synchronized to move at the same speed. In this way, the printing medium 1 placed on the first transport belt 4 and the second transport belt 5 can be transported in the transport direction denoted by the arrow. In this embodiment, as described below, the printing medium 1 is absorbed to be transported by the first endless belts 6 and the second endless belts 7.

The first ink jet heads 2 and the second ink jet heads 3 of four colors, for example, yellow (Y), magenta (M) cyan (C), and black (K) are disposed so as not to overlap each other in the transport direction of the printing medium 1. Ink is supplied from each of color ink tanks (not shown) to the first ink jet heads 2 and the second ink jet heads 3 through the corresponding ink supply tube. In the first ink jet heads 2 and the second ink jet heads 3, a plurality of nozzles are formed in the direction (that is, the nozzle row direction) intersecting the transport direction of the printing medium 1. In addition, necessary ink droplets are ejected simultaneously or almost simultaneously through the nozzles to form minute ink dots on the printing medium 1. The printing operation can be completed by ejecting the ink droplets of each of the colors in this manner and transporting the printing medium 1 by use of the first transport belt 4 and the second transport belt 5 just once, which refers to a so-called one-pass printing operation. That is, the printing area corresponds to the area where the first ink jet heads 2 and the second ink jet heads 3 are disposed.

Examples of a method of ejecting ink through each nozzle of an ink jet head include an electrostatic type, a piezo type, and a film boiling ink jet type. In the electrostatic type, when a driving signal is supplied to an electrostatic gap, which is an actuator, displacement of a vibration plate in a cavity occurs, the displacement of the vibration plate causes variation in pressure of the cavity, and the variation in the pressure induces ink droplets to be ejected through a nozzle. In the piezo type, when a driving signal is supplied to a piezo element, which is an actuator, displacement of a vibration plate in a cavity occurs, the displacement of the vibration plate causes variation in pressure of the cavity, and the variation in the pressure induces ink droplets to be ejected through a nozzle. In the film boiling ink jet type, since a small heater is disposed in a cavity, ink is instantaneously heated at 300° C. or more to be boiled and bubbles are generated, variation in pressure induces ink droplet to be ejected through a nozzle. The invention can be applied to any ink ejecting method.

The first ink jet heads 2 are disposed between the four first endless belts 6 of the first transport belt 4 and below the first endless belt 6 on the lowest side in top view in FIG. 1A. In addition, the second ink jet heads 3 are disposed between the four second endless belts 7 of the second transport belt 5 and above the second endless belt 7 on the uppermost side in top view in FIG. 1A. The first ink jet heads 2 and the second ink jet heads 3 are disposed in this manner, so that first cleaning members 11 and second cleaning members 12 disposed below the first endless belts 6 and the second endless 7 clean the first ink jet heads 2 and the second ink jet heads 3, respectively. However, the ink jet head on one part cannot print the entire surface of the printing medium by the one-pass printing operation. Accordingly, in order to print the non-print portion of the printing medium, the first ink jet heads 2 and the second ink jet heads 3 are disposed so as not to overlap each other in the transport direction of the printing medium 1. The first cleaning members 11 and the second cleaning members 12 are received in concave portions of first and second support members, which are described below.

A pair of two gate rollers 14 that adjust feed timing of the printing medium 1 fed from a feeding unit 15 and correct skew of the printing medium 1 are disposed on the upstream side of the first driven roller 9. The skew refers to distortion of the printing medium 1 in the transport direction. A feed roller (not shown) that feeds the printing medium 1 from the feeding unit 15 is disposed on the more upstream side of the gate rollers 14.

A first belt charging unit and a second belt charging unit are disposed below the first driven roller 9 and the driving roller 8, respectively. The first belt charging unit is constituted by a first charge roller 20 in contact with the first endless belts 6 with the first driven roller 9 interposed therebetween and a first alternating-current source (not shown) applying electric charges to the first charge roller 20. The second belt charging unit is constituted by a second charge roller 22 in contact with the second endless belts 7 with the driving roller 8 interposed therebetween and a second alternating-current source (not shown) applying electric charges to the second charge roller 22. The electric charges are applied from the first charge roller 20 and the second charge roller 22 to the first endless belts 6 and the second endless belts 7 to charge the first charge roller 20 and the second charge roller 22. First and second alternating-current sources apply an alternating voltage of frequency in the range of about 10 to 50 Hz. In general, the belts are made of a mid/high-resistance material or an insulating material. When the belts are charged by the belt charging units, the electric charges applied to the surface of the belts cause charge polarization to the printing medium 1 made of a high-resistance material or an insulating material likewise. Moreover, the printing medium 1 can be absorbed by use of an electrostatic force generated between the charges caused by the charge polarization and the charges of the surfaces of the belts. As a charging unit, a corotron that lowers electric charges may be used.

Figure 2:
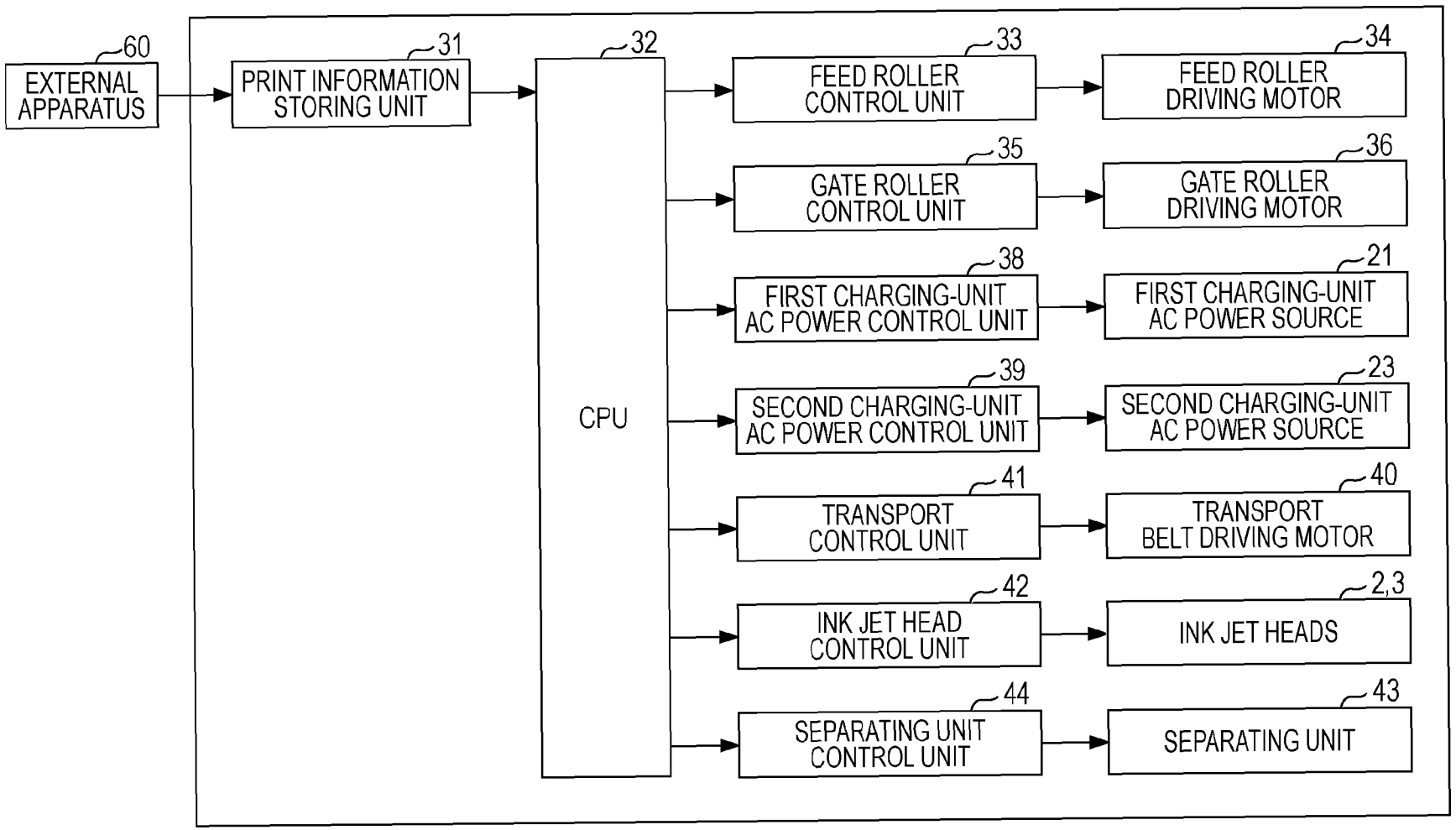
FIG. 2 is a block diagram illustrating the configuration of the ink jet printer in FIG. 1.

The ink jet printer is provided with a control unit that controls the ink jet printer. As shown in FIG. 2, the control unit controls a printing unit, the feeding unit, a discharging unit, or the like to perform the printing operation on the printing medium 1 on the basis of print information input from an external apparatus 60 such as a personal computer or a digital camera. In addition, the ink jet printer includes a print information storing unit 31 that stores the print information input from the external apparatus 60, a central processing unit (CPU) 32 that performs various processing operations such as a printing operation, a feed roller control unit 33 that controls a feed roller driving motor 34 for driving the feed roller on the basis of an instruction of the CPU 32, a gate roller control unit 35 that controls a gate roller driving motor 36 for driving the gate rollers 14 on the basis of the instruction of the CPU 32, a first charging-unit AC power control unit 38 that controls a first charging-unit AC power source 21 on the basis of the instruction of the CPU 32, a second charging-unit AC power control unit 39 that controls a second charging-unit AC power source 23 on the basis of the instruction of the CPU 32, a transport control unit 41 that controls the transport belt driving motor 40 for driving the driving roller 8 on the basis of the instruction of the CPU 32, an ink jet head control unit 42 that controls the first ink jet heads 2 and the second ink jet heads 3 on the basis of the instruction of the CPU 32, and a separating unit control unit 44 that controls a separating unit 43 of a discharging unit on the basis of the CPU 32.

In the ink jet printer, the printing medium 1 is absorbed on the surfaces of the first endless belts 6 by the charge polarization in a manner that the first charge roller 20 of the first belt charging unit charges the surface of the first endless belts 6, the printing medium 1 is fed from the feed roller, the gate roller 14 controls posture of the printing medium 1 and supplies the printing medium 1 onto the first endless belts 6, and a pressing roller (not shown) presses the printing medium 1 against the first endless belts 6. At this time, when the driving roller 8 is rotatably driven by the transport belt driving motor, the driving force of the rotation is transmitted to the first driven roller 9 through the first endless belts 6.

When the printing medium 1 is absorbed in this manner, the first endless belts 6 are moved downstream side in the transport direction and the printing medium 1 is moved to a position below the first ink jet heads 2. At this time, the ink droplets are ejected from the nozzles formed in the first ink jet heads 2 to perform the printing operation. When the printing operation of the first ink jet heads 2 is completed, the printing medium 1 is moved downstream in the transport direction to be loaded on the second endless belts 7 of the second transport belt 5. As described above, the surfaces of the second endless belts 7 are also charged by the second charge roller 22. Accordingly, the printing medium 1 is absorbed on the surfaces of the second endless belts 7 by the charge polarization described above.

At this time, the second endless belts 7 are moved downstream in the transport direction and the printing medium 1 is moved to a position below the second ink jet heads 3 to perform the printing operation in a manner that the ink droplets are ejected from the nozzles formed in the second ink jet heads 3. When the second ink jet heads 3 complete the printing operation, the printing medium 1 is further moved downstream in the transport direction. Subsequently, the printing medium 1 is separated from the surfaces of the second endless belts 7 by the separating unit (not shown) so as to be discharged to the discharging unit.

When the first ink jet heads 2 and the second ink jet heads 3 need to be cleaned, the first cleaning members 11 and the second cleaning members 12 described above are elevated to closely attach to the nozzle surfaces of the first ink jet heads 2 and the second ink jet heads 3 and to clean the cleaning members to the first ink jet heads 2 and the second ink jet heads 3 by absorbing ink droplets or bubbles through the nozzles of the first ink jet heads 2 and the second ink jet heads 3. Afterward, the first cleaning members 11 and the second cleaning members 12 descend.

First support members 16 and second support members 17 are disposed between the first endless belts 6 of the first belt 4 and the second endless belts 7 of the second belt 5, respectively. A plurality of plate-like members 13 protrude from base portions 16*a* and 17*a* disposed below the circumferential surfaces of the first endless belts 6 and the second endless belts 7, respectively. The height of upper ends of the plate-like members 13 are configured to be the same as that of the upper portions the circumferential surfaces of the first endless belts 6 and the second endless belts 7. In this way, the printing medium 1 is supported on the first endless belts 6 and second endless belts 7. The plate-like members 13 are long in the transport direction of the printing medium 1 and are thin in the direction intersecting the transport direction of the printing medium 1. Three plate-like members 13 are erectly arranged between the adjacent first endless belts 6 in the direction intersecting the transport direction of the printing medium 1. Likewise, three plate-like members 13 are arranged between the adjacent second endless belts 7. It is possible to reduce contact resistance or movement resistance between the plate-like members 13 and the transported printing medium 1 by erectly disposing the plate-like members 13 which are thin in the direction intersecting the transport direction of the printing medium 1 and long in the transport direction of the printing medium 1 between the adjacent endless belts 6 and between the adjacent endless belts 7, respectively. In this way, the transport failure or so-called paper-sheet jam can be prevented.

Figure 3A:
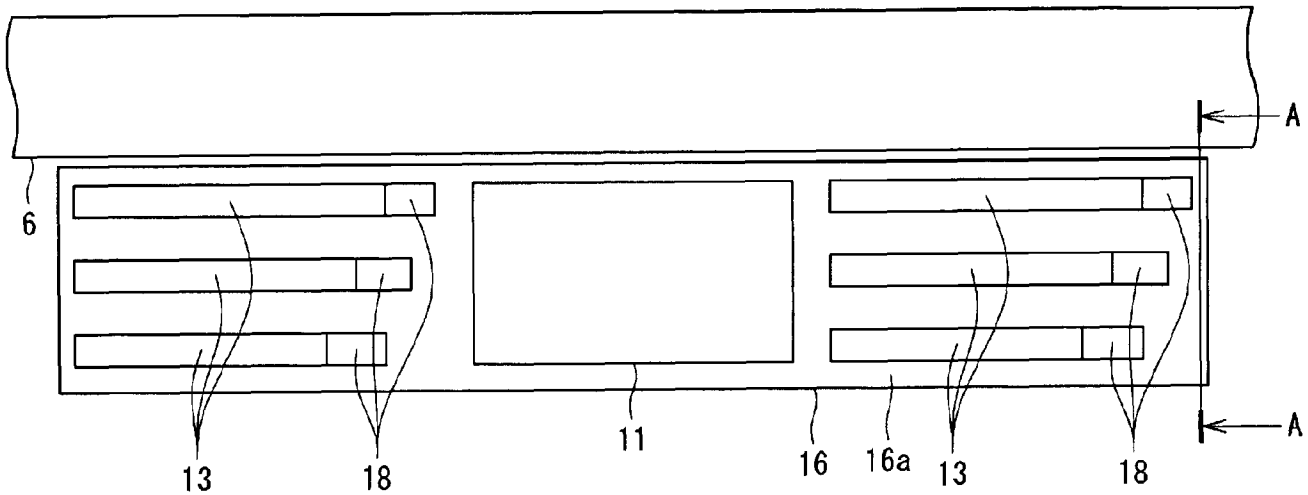
FIG. 3A is a top view illustrating plate-like members and chamfered portions constituting a support member of the ink jet printer in FIG. 1
Figure 3B:
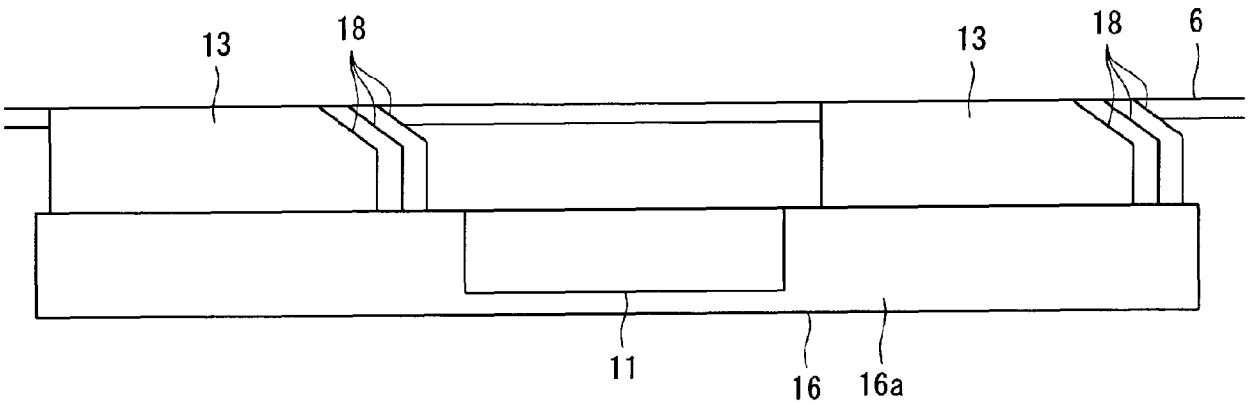
FIG. 3B is a front view illustrating plate-like members and chamfered portions constituting a support member of the ink jet printer in FIG. 1.

The upper end portions of the plate-like members 13 upstream side in the transport direction of the printing medium 1 are chamfered and the chamfered portions (C chamfered portions) are of the same size. In this embodiment, as indicated by the two-dotted line in FIG. 1A, the printing medium 1 with different length (hereinafter, also referred to as a width) in the direction intersecting the transport direction is transported to the first ink jet heads 2 and the second ink jet heads 3. In this way, when the printing medium 1 with the different width is transported, the lengths of plate-like member 13 in the transport direction of the printing medium 1 become shorter as they are positioned closer to the end portions of the transported printing medium 1 in the transverse direction of the printing medium 1 and become longer as they are positioned closer to the inner portions of the transported printing medium. In FIGS. 3A and 3B, among the first support members 16 and the second support members 17, the plate-like members 13 of the first support members 16 are representatively shown. The lengths of the plate-like members 13 in the transport direction of the printing medium become shorter in the end portions of the transported printing medium 1 in the transverse direction as they are disposed closer to the end portions of the printing medium in the transverse direction of the printing medium and become longer in the inner portions of the transported printing medium 1 in the transverse direction as they are disposed closer to the inner portions of the printing medium in the transverse direction of the printing medium. Accordingly, the chamfered portions 18 formed in the plate-like members 13 come in contact with the end portions of the printing medium 1 in the transverse direction at late timing as they are disposed closer to the end portions of the printing medium in the transverse direction of the printing medium, and the chamfered portions 18 come in contact with the inner portions of the printing medium 1 in the transverse direction of the printing medium 1 at earlier timing as they are disposed closer to the inner portions of the printing medium in the transverse direction of the printing medium.

Figure 4A:
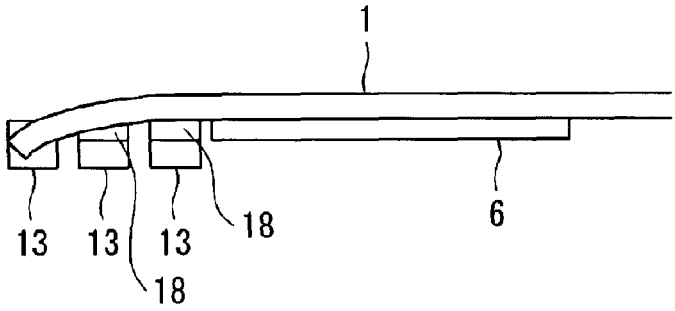
FIGS. 4A to 4C are diagrams for explaining an operation of the plate-like members and the chamfered portions taken along the line A-A shown in FIG. 3.
Figure 4B:
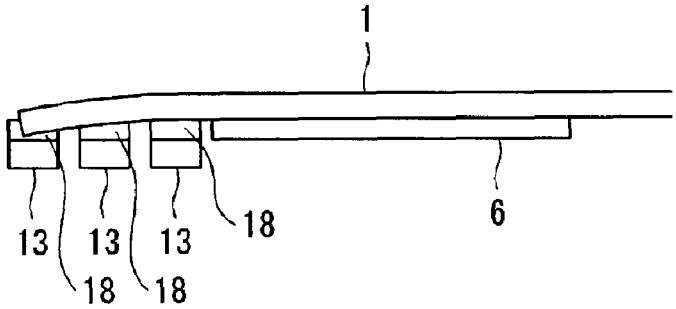
Figure 4C:
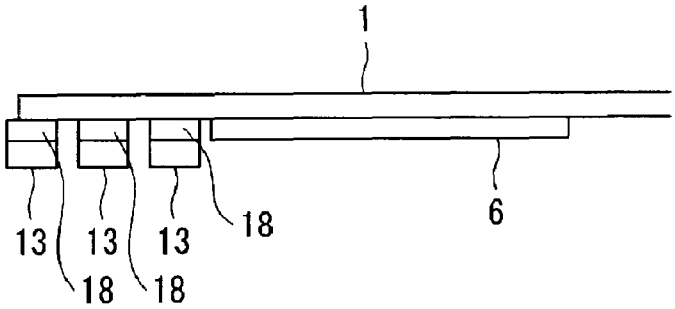

In general, as shown in FIG. 4A, the end portions of the printing medium 1 that are not loaded on the first endless belts 6 in the transverse direction of the printing medium 1 further droop. However, the inner end portions of the printing medium 1 that are not loaded on the first endless belt 6 in the transverse direction of the printing medium 1 do not further droop. In this embodiment, the inner portions of the printing medium 1 in the transverse direction first come in contact with the chamfered portions 18 of the plate-like members 13. Accordingly, the inner portions are lifted by the chamfered portions 18 of the plate-like members 13 during the transport of the printing medium 1, and therefore the end portions outer than the inner portions less droop. As shown in FIG. 4B, the end portions outer than the inner portions of the printing medium 1 in the transverse direction come in contact with the chamfered portions 18 and are lifted by the chamfered portions 18 of the plate-like members 13 during the transport of the printing medium 1. Consequently, the end portions outer than the inner portions of the printing medium 1 in the transverse direction less droops. As shown in FIG. 4C, the less drooping end portions of the printing medium 1 in the transverse direction come in contact with the chamfered portions of the plate-like members 13 and are lifted by the chamfered portions 18 of the plate-like members 13 during the transport of the printing medium 1. Consequently, all the end portions of the printing medium 1 in the transverse direction are loaded on the upper portion of the plate-like members 13 of the first support members 16 and the second support members 17, thereby adjusting posture of the printing medium 1.

According to the ink jet printer according to this embodiment, the first support members 16 and the second support members 17 that gradually lift the end portions of the transported printing medium 1 in the direction intersecting the transport direction up to the height of the circumferential surfaces of the first endless belts 6 and the second endless belts 7 are disposed between the plurality of first endless belts 6, between the plurality of second endless belts 7, and below the circumferential surfaces of the first endless belts 6 and the second endless belts 7. Then, the first support members 16 and the second support members 17 lift the end portions of the transported printing medium 1 in the direction intersecting the transport direction at later timing they are positioned closer to the end portions of the printing medium 1 in the direction intersecting he transport direction, but the inner portions thereof at earlier timing as they are positioned closer to the inner portions of the printing medium in the direction intersecting the transport direction. Accordingly, the further drooping end portions of the printing medium 1 in the direction intersecting the transport direction are gradually lifted and the end portions of the printing medium 1 in the direction intersecting the transport direction are lifted by the first support members 16 and the second support members 17. Accordingly, the first support members 16 and the second support members 17 can be prevented from colliding with the end portions of the printing medium 1 in the direction of the transport direction. Consequently, it is possible to lift the drooping end portions of the printing medium 1 in the direction intersecting the transport direction to the circumferential surfaces of the first endless belts 6 and the second endless belts 7 without the transport failure of the printing medium 1.

The plurality of plate-like members 13 are disposed in the direction of the transport direction of the printing medium 1 to form the first support members 16 and the second support members 17. Moreover, the plate-like members 13 gradually lift the end portions of the transported printing medium 1 in the direction intersecting the transport direction up to the height of the circumferential surfaces of the first endless belts 6 and the second endless belts 7 at the later timing as they are positioned closer to the end portions of the printing medium in the direction intersecting the transport direction. Accordingly, the considerably drooping end portions of the printing medium 1 in the direction of the transport direction are gradually lifted and the end portions of the printing medium 1 in the direction intersecting the transport direction are lifted by the plate-like members 13. Consequently, the plate-like members 13 of the first support members 16 and the second support members 17 can be reliably prevented from colliding with the end portions of the printing medium 1 in the direction intersecting the transport direction.

Figure 5:
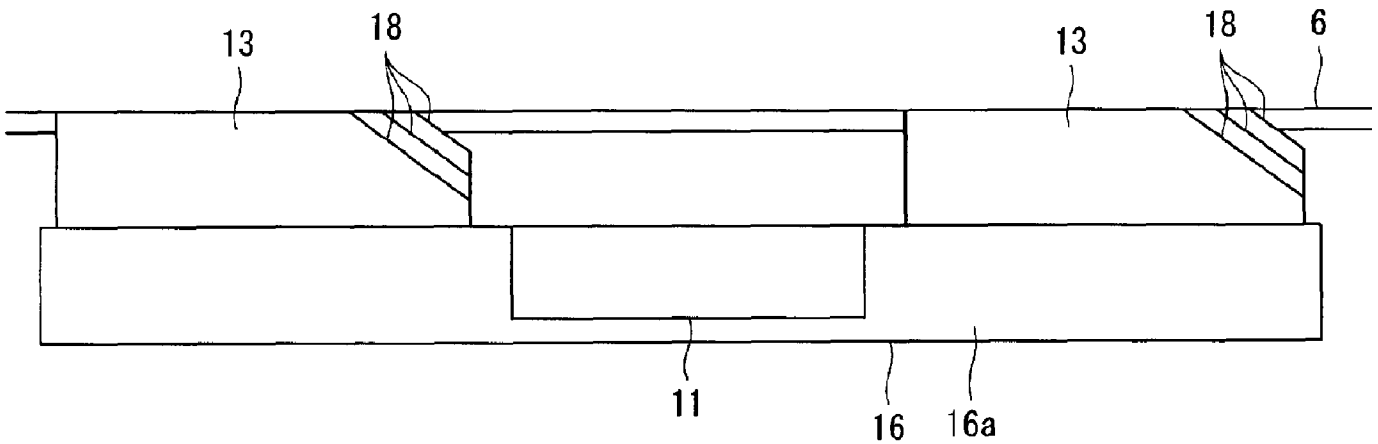
FIG. 5 is a front view illustrating plate-like members and chamfered portions of an ink jet printer according to a second embodiment of the invention.

Next, an ink jet printer according to a second embodiment of the invention will be described. An overall configuration of the ink jet printer according to the second embodiment is the same as that shown in FIG. 1 according to the first embodiment. The plate-like members 13 of the first support members 16 and the second support members 17 and the chamfered portions 18 formed in the plate-like members 13 are modified. Among plate-like members 13 and chamfered portions 18, the plate-like members 13 erectly disposed in a first support member 16 and the chamfered portions 18 thereof are shown in FIG. 5. The plate-like members 13 according to the second embodiment have the same length, but the chamfered portions 18 become larger in the end portions of a printing medium 1 in a transverse direction of the printing medium 1 as they are positioned closer to the end portions of the printing medium in the transverse direction of the printing medium 1. Accordingly, in the second embodiment, the chamfered portions 18 of the plate-like members 13 also come in contact with the end portions of the printing medium 1 in the transverse direction at later timing as they are positioned closer to the end portions in the transverse direction of the printing medium. As a result, the same advantages according to the first embodiment can be obtained.

In the ink jet printer according to the second embodiment, the portions 18 of the plurality of plate-like members 13 upstream in the transport direction of the printing medium 1 are chamfered and the chamfered portions 18 of the plate-like members 13 become larger as they are positioned closer to the end portions of the printing medium 1 in a direction intersecting the transport direction. Therefore, the plate-like members 13 gradually lift the portion end portions of the transported printing medium 1 in the direction intersecting the transport direction up to the height of circumferential surfaces of transport belts 6 and 7 at the later timing as they are positioned closer to the end portions of the printing medium in the direction intersecting the transport direction.

Figure 6:
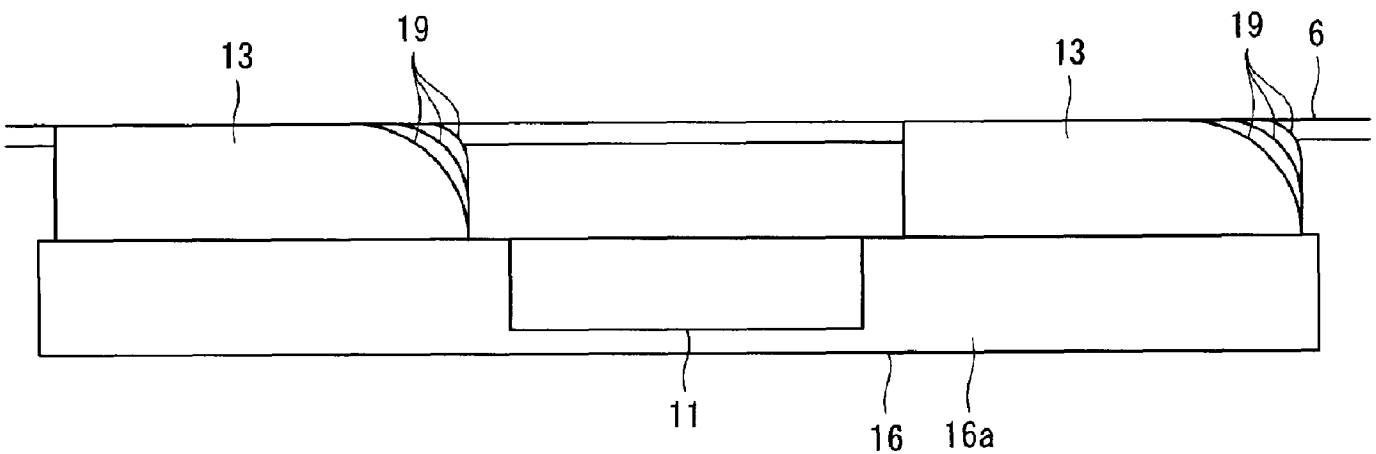
FIG. 6 is a front view illustrating plate-like members and chamfered portions of an ink jet printer according to a third embodiment of the invention.

Next, an ink jet printer according to a third embodiment of the invention will be described. An overall configuration of the ink jet printer according to the third embodiment is the same as that shown in FIG. 1 according to the first embodiment. However, the plate-like members 13 of the first support members 16 and the second support members 17 and the structure, which is formed on the plate-like members 13 for lifting the printing medium are modified. Among plate-like members 13 and the structure for lifting the printing medium, the plate-like members 13 erectly disposed in first support members 16 and the structure for lifting the printing medium are shown in FIG. 6. The plate-like members 13 according to the third embodiment have the same length and the curved portions 19 are formed in the upper end portions upstream in a transport direction of the printing medium. The radii of the curved portions 19 are larger they are positioned closer to the end portions of a printing medium 1 in a transverse direction of the printing medium 1. Accordingly, in the third embodiment, the curved portions 19 of the plate-like members 13 also come in contact with the end portions of the printing medium 1 in the transverse direction at later timing they are positioned closer to the end portions of the printing medium 1 in the transverse direction of the printing medium 1. As a result, the same advantages according to the first embodiment can be obtained.

In the ink jet printer according to the third embodiment, the curved portions 19 of the plurality of plate-like members 13 upstream in the transport direction of the printing medium 1 are formed and the radii of the curved portions 19 of the plate-like members 13 are larger they are positioned closer to the end portions of the printing medium 1 in a direction intersecting the transport direction. Therefore, the curved portions 19 of the plate-like members 13 gradually lift the end portions of the transported printing medium 1 in the direction intersecting the transport direction up to the height of circumferential surfaces of transport belts 6 and 7 at the later timing as they are positioned closer to the end portions of the printing medium 1 in the direction intersecting the transport direction.

In the above-described embodiments, the ink jet heads disposed at two positions upstream and downstream in the transport direction of the printing medium have been described. However, the positions where the ink jet heads are disposed are not limited thereto. That is, the ink jet heads may be disposed at one position or three positions. As long as the support members are disposed between the plurality of transport belts and the chamfered portions or the curved portions of the plate-like members erectly disposed in the support members are formed in the same manner according to each of the embodiments, the same advantages according to each of the embodiments can be obtained.

In the above-described embodiments, as the ink jet printer according to the invention, the so-called line head type ink jet printer has been described in detail. However, as the ink jet printer according to the invention, various types of the ink jet printer may be used.

What is claimed is:

1. An ink jet printer in which a plurality of transport belts are disposed at a predetermined interval in a direction intersecting a transport direction of a printing medium, the printing medium is absorbed on the transport belts to be transported, and an ink jet head ejects an ink droplet on the printing medium transported by the transport belts to perform a printing operation, and wherein a support member that gradually lifts end portions of the transported printing medium in the direction intersecting the transport direction toward a height of circumferential surfaces of the transport belts is disposed between the plurality of transport belts and below the circumferential surfaces of the transport belts, wherein the support member includes a plurality of plate-like members that are disposed in the direction intersecting the transport direction of the printing medium, and wherein the plate-like members gradually lift the end portions of the transported printing medium in the direction intersecting the transport direction at later timing as the plate-like members are closer to the end portions of the transported printing medium in the direction intersecting the transport direction.

2. The ink jet printer according to claim 1, wherein portions of the plurality of plate-like members upstream in the transport direction are chamfered, and wherein the chamfered portions of the plate-like members become larger as they are positioned closer to the end portions of the transported printing medium in the direction intersecting the transport direction.

3. The ink jet printer according to claim 1, wherein portions of the plurality of plate-like members upstream in the transport direction are curved, and wherein the radii of the curved portions of the plate-like members become larger as they are positioned closer to the end portions of the transported printing medium in the direction intersecting the transport direction.

* * * * *